US005672972A

United States Patent [19]

McCoy et al.

[11] Patent Number: 5,672,972

[45] Date of Patent: Sep. 30, 1997

[54] DIAGNOSTIC SYSTEM FOR A CAPACITOR DISCHARGE IGNITION SYSTEM

[75] Inventors: Steven R. McCoy, Washington; Horst Scheel, Peoria, both of Ill.

[73] Assignee: Caterpillar Inc., Peoria, Ill.

[21] Appl. No.: 946,491

[22] PCT Filed: May 27, 1992

[86] PCT No.: PCT/US92/04515

§ 371 Date: Nov. 9, 1992

§ 102(e) Date: Nov. 9, 1992

[87] PCT Pub. No.: WO92/21876

PCT Pub. Date: Oct. 12, 1992

[51] Int. Cl.[6] ..... F02P 5/145; F02P 17/00

[52] U.S. Cl. ..... 324/393; 123/605; 324/388; 324/391

[58] Field of Search ..... 324/380, 388, 324/391, 393, 399, 402; 73/116, 117.3; 123/605

[56] References Cited

U.S. PATENT DOCUMENTS

| | | | |
|---|---|---|---|
| 4,312,043 | 1/1982 | Frank et al. | 324/391 |
| 4,413,508 | 11/1983 | Kamamura et al. | 324/391 |
| 5,019,779 | 5/1991 | Ookawa | 324/388 |
| 5,060,623 | 10/1991 | McCoy | 123/605 |
| 5,156,127 | 10/1992 | Ghaem | 324/391 |
| 5,208,540 | 5/1993 | Hoeflich | 324/388 |
| 5,216,369 | 6/1993 | Toyama | 324/388 |
| 5,237,279 | 8/1993 | Shimasaki et al. | 324/391 |

FOREIGN PATENT DOCUMENTS

| | | |
|---|---|---|
| 0 389 775 | 10/1990 | European Pat. Off. . |
| 2 493 414 | 5/1982 | France . |
| WO 88/01690 | 3/1988 | WIPO . |

*Primary Examiner*—Maura K. Regan

*Attorney, Agent, or Firm*—Kirk A. Vander Leest; R. Carl Wilbur

[57] ABSTRACT

An apparatus is provided for monitoring ignition in individual cylinders of a multi-cylinder engine of the type having an ignition system which includes a separate transformer for each cylinder. Each transformer has primary and secondary coils. The secondary coil is connected in series with a spark gap in an associated one of the cylinders. The ignition system further includes selector switches for receiving cylinder select signals and responsively connecting respective transformer primary coils. The current flows through the primary coil resulting in a voltage potential across an associated spark gap which normally increases to a magnitude sufficient to cause a spark across the spark gap. A first circuit receives the cylinder select signals, senses time delay between the reception of a cylinder select signal and sparking in a respective cylinder and responsively produces a delay signal indicative of the sensed time delay. A diagnostics controller receives the delay signal, compares the delay signal to a plurality of preselected thresholds and responsively produces a status signal indicating the status of ignition in a respective cylinder.

15 Claims, 10 Drawing Sheets

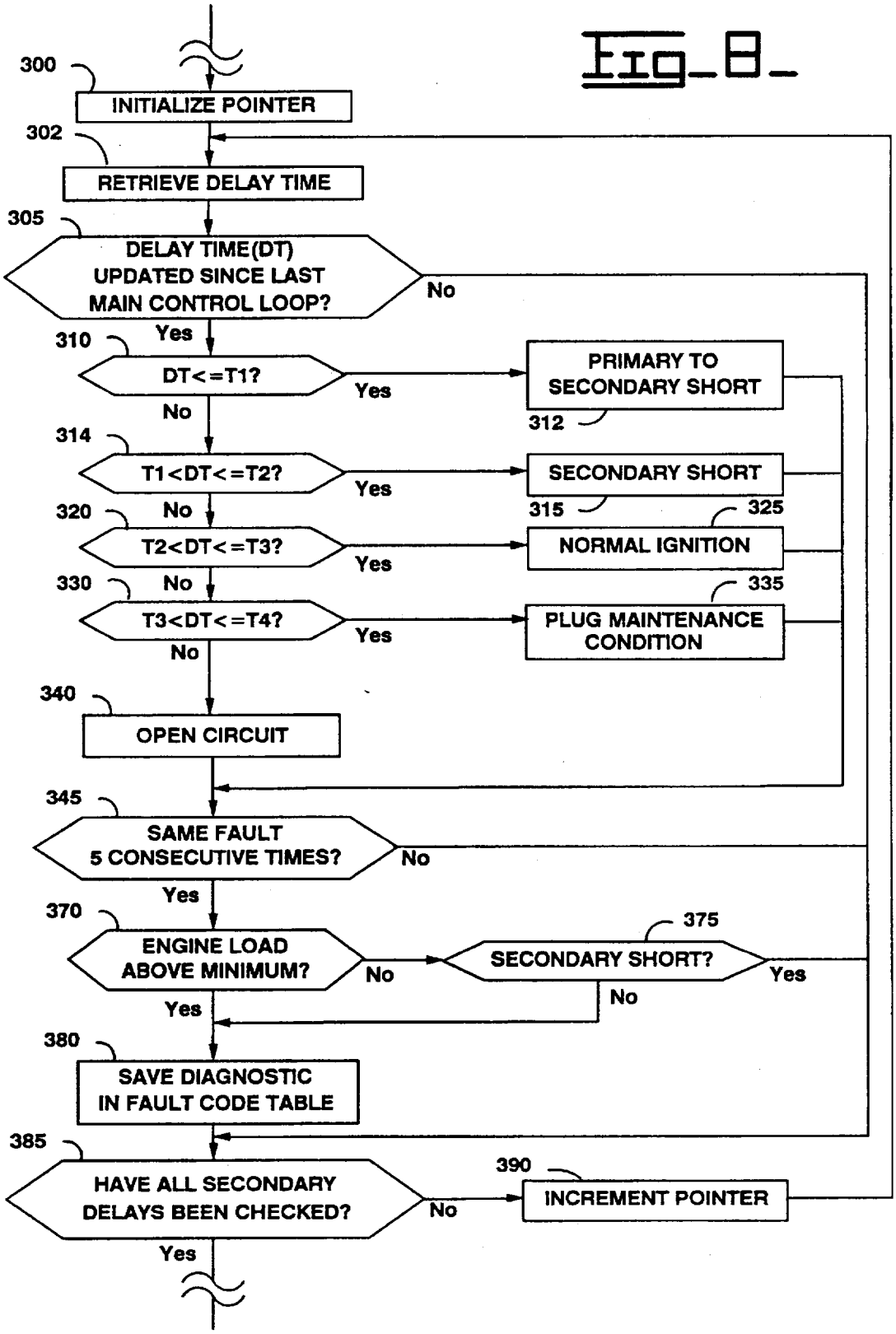
Fig_8_
300
INITIALIZE POINTER
302
RETRIEVE DELAY TIME
305
DELAY TIME(DT) UPDATED SINCE LAST MAIN CONTROL LOOP?
No
Yes
310
DT<=T1?
Yes
PRIMARY TO SECONDARY SHORT
312
No
314
T1<DT<=T2?
Yes
SECONDARY SHORT
315
No
320
T2<DT<=T3?
Yes
NORMAL IGNITION
325
No
330
T3<DT<=T4?
Yes
PLUG MAINTENANCE CONDITION
335
No
340
OPEN CIRCUIT
345
SAME FAULT 5 CONSECUTIVE TIMES?
No
Yes
370
ENGINE LOAD ABOVE MINIMUM?
No
375
SECONDARY SHORT?
Yes
No
Yes
380
SAVE DIAGNOSTIC IN FAULT CODE TABLE
385
HAVE ALL SECONDARY DELAYS BEEN CHECKED?
No
390
INCREMENT POINTER
Yes

DIAGNOSTIC SYSTEM FOR A CAPACITOR DISCHARGE IGNITION SYSTEM

TECHNICAL FIELD

This invention relates generally to a diagnostic system for an internal combustion engine and, more particularly, to a system for detecting electrical faults in a capacitor discharge ignition system.

BACKGROUND ART

Capacitor discharge ignitions (CDI's) are well known in the art. Typically, CDI's include a charge storage mechanism, such as a capacitor, and a step-up transformer with a secondary coil connected to a spark ignition device, such as a spark plug. A mechanism is provided to discharge the capacitor through the transformer primary coil in timed relationship with a desired engine ignition sequence. Discharge of the capacitor through the transformer primary coil induces a high voltage signal in the transformer secondary coil, which, if sufficiently high, causes a spark to arc across the spark plug gap. More specifically, the voltage applied across a spark ignition device must be greater than or equal to a predetermined characteristic "spark ionization potential" (voltage) $V_{SP}$ in order to initiate the spark. Such ionization potentials are typically on the order of 10 Kv or more. The ionization potential $V_{SP}$ is dependent on factors such as spark plug gap, cylinder pressure, engine load, and air/fuel ratio.

Typically, a CDI includes a separate transformer for each engine cylinder. As such it is possible for electrical faults, such as an electrical short in a transformer secondary circuit, to occur in any one of the engine cylinders. Such a fault will result in a deterioration of the overall engine operation and, therefore, it is desirable to be able to detect such faults. However, to date little work has been done in providing detection and diagnostics of electrical faults in the transformer secondary circuit.

Currently, when a fault is suspected, the first step typically is to replace or regap all the spark plugs in the engine. If this does not correct the problem, it is common to systematically replace individual transformers until proper engine performance resumes. Such methods result in substantial delays in downtime and lost productivity from the engine. Therefore, it is desirable to provide a means for detecting electrical faults in the secondary circuits of individual engine cylinders and to provide an indication of the particular type of fault that is detected.

The subject invention is directed toward addressing one or more of the problems as set forth above by providing a diagnostic system for a capacitor discharge ignition system which can detect a variety of electrical faults in individual cylinders. Furthermore, the subject invention is capable of providing an indication of when individual spark plugs need to be replaced or regapped.

DISCLOSURE OF THE INVENTION

In one aspect of the present invention, an apparatus is provided for monitoring ignition in individual cylinders of a multicylinder engine of the type having an ignition system which includes separate transformers for each cylinder. Each transformer has primary and secondary coils. The secondary coils are electrically connected in series with spark gaps in associated engine cylinders. The ignition system further includes a switching circuit for receiving cylinder select signals and responsively connecting respective transformer primary coils to a power source to induce current flow through a respective primary coil. The current flow through the primary coil results in a voltage potential across an associated spark gap which normally increases to a magnitude sufficient to cause a spark across the spark gap. A first circuit receives the cylinder select signals, senses a time delay between the reception of a cylinder select signal and sparking in a respective cylinder and responsively produces a delay signal indicative of the sensed time delay. A diagnostic controller receives the delay signal, compares the delay signal to a plurality of preselected thresholds and responsively produces a status signal indicating the status of ignition in a respective cylinder.

In a second aspect of the present invention, an apparatus is provided for monitoring ignition in an engine cylinder. Ignition in the engine cylinder is controlled by an ignition system which includes a transformer having primary and secondary coils, wherein the secondary coil is electrically connected in series with a spark gap in the cylinder. The ignition system further includes a circuit for receiving a cylinder select signal and responsively connecting the transformer primary coil to a power source to induce current flow through the primary coil which results in a voltage potential across an associated spark gap. The current normally increases to a magnitude sufficient to cause a spark across the spark gap. A current sensing circuit senses a current flowing through the primary coil and responsively produces a primary current signal. A monostable multivibrator is adapted to receive the primary current signal and responsively produce a stop time signal when the primary current signal reaches a preselected threshold which is sufficient to cause a spark to arc the spark gap. A timer receives the cylinder select and stop time signals and produces a delay signal in response to a time delay between the reception of the cylinder select and stop time signals. A diagnostic controller receives the delay signal and produces a primary to secondary short signal in response to the delay signal being within a first range of values, produces a secondary short circuit signal in response to the delay signal being within a second range of values which exceeds the first range of values, produces a normal ignition signal in response to the delay signal being within a third range of values which exceeds the first and second ranges of values, produces a plug maintenance signal in response to the delay signal being within a fourth range of values which exceeds the first, second and third ranges of values, and produces an open circuit signal in response to the delay signal exceeding the first, second, third and fourth ranges of values.

BRIEF DESCRIPTION OF THE DRAWINGS

FIG. 8 is a software flowchart illustrating a Diagnostic Subroutine performed by the immediate invention;

BEST MODE FOR CARRYING OUT THE INVENTION

Figure 1:
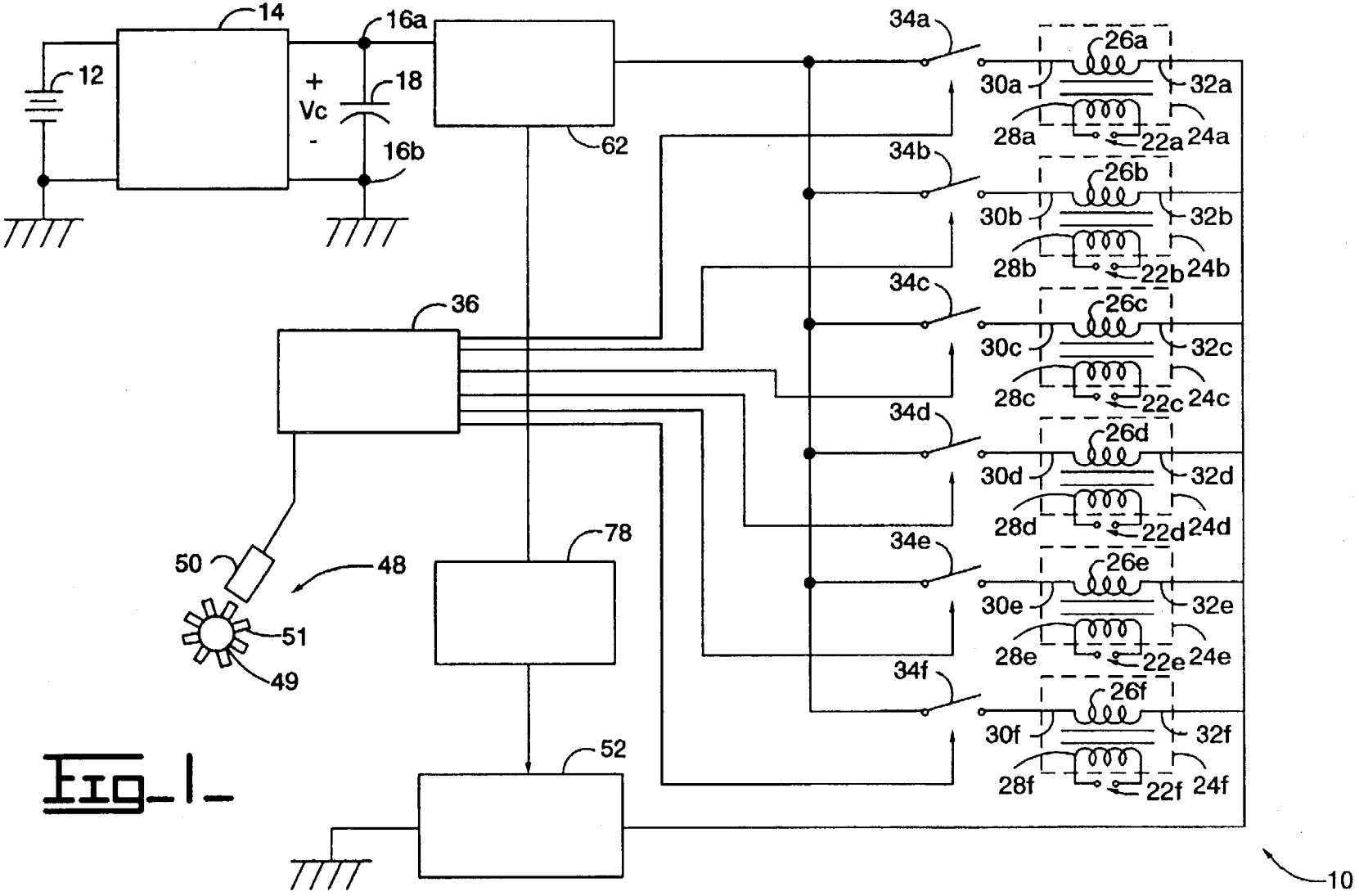
FIG. 1 is an illustrative block diagram of a capacitive discharge ignition system which can be adapted for use with the immediate invention.

Referring now to the drawings, the immediate engine diagnostic system S will be described in connection with a capacitor discharge ignition system 10. The diagnostic system 8 can be adapted for use with numerous capacitor discharge ignition systems, as should be apparent to one skilled in the art. However, the diagnostic system 8 will be described in connection with an ignition system as disclosed in U.S. Pat. No. 5,060,623 which issued on Oct. 29, 1991 to McCoy and the disclosure of which is specifically incorporated by reference.

Figure 2:
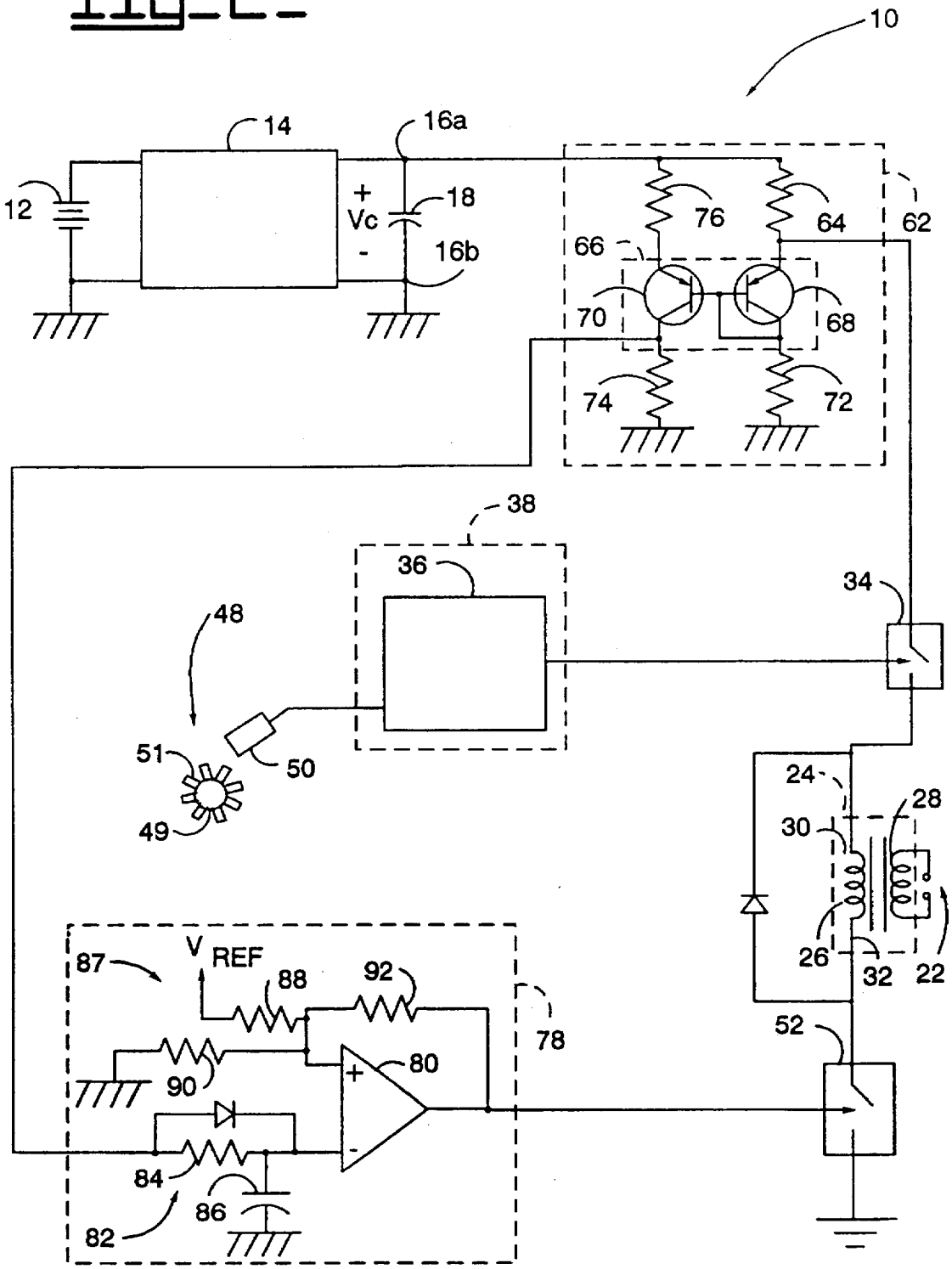
FIG. 2 is a circuit diagram of the capacitive discharge ignition system of FIG. 1.
Figure 3:
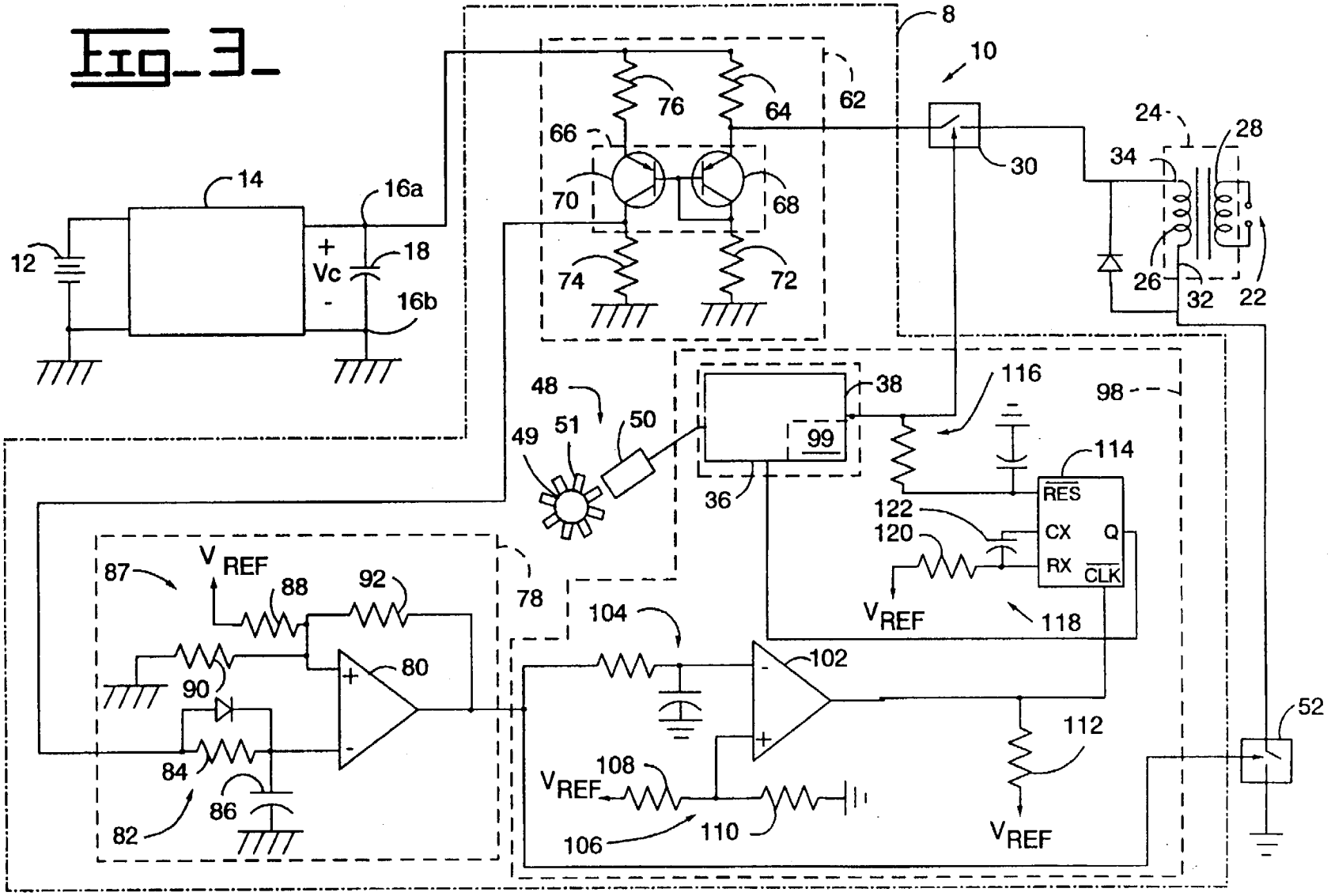
FIG. 3 is a circuit diagram of the ignition system of FIGS. 1 and 2 incorporating the immediate invention.

The ignition system 10 is shown generally in FIGS. 1 and 2. FIG. 3 illustrates the ignition system 10 incorporating the immediate diagnostic system 8. The diagnostic and ignition systems 8, 10 will work with an internal combustion engine having any number of cylinders provided electrical components are sized properly. Currently, the diagnostic and ignition systems 8,10 are being developed for use with a series 3500 SI engine as manufactured by Caterpillar Inc. of Peoria, Ill. The series 3500 SI engine has 16 cylinders; however, for simplification FIG. 1 is described in connection with a six cylinder engine and FIGS. 2 and 3 are illustrated in connection with a single engine cylinder.

The ignition system 10 includes a power source 12, such as a battery, connected to a DC-to-DC power converter 14. The power converter 14 is a continuously operating, high speed charging circuit, and it is electrically connected to first and second terminals 16*a*,16*b* of an ignition capacitor 18. The power converter 14 is provided for rapidly charging the ignition capacitor 18 and continuously supplying power to the capacitor 18 to maintain the capacitor first terminal 16*a* at a predetermined electrical potential above the capacitor second terminal 16*b*. More particularly, the capacitor second terminal 16*b* is connected to system ground and the first terminal 16*a* is maintained a preselected potential $V_c$ above system ground. In the preferred embodiment, the preselected potential $V_c$ is on the order of 200 volts. Power converters of this type are common in the art and, therefore, will not be explained in greater detail. One such circuit is generally disclosed in U.S. Pat. No. 3,677,253 which issued on Jul. 18, 1972 to Oishi et al.

Each engine cylinder (not shown) includes a spark plug (not shown) having an associated spark gap 22. Step-up transformers 24*a–f* are provided for each cylinder to control operation of an associated spark plug. Each transformers 24*a–f* has a primary coil 26 *a–f* and a secondary coil 28*a–f*. The transformer primary coils 26*a–f* each include first and second terminals 30*a–f*, 32*a–f*. The transformer secondary coils 28*a–f* are electrically connected in series with spark gaps 22*a–f* in an associated engine cylinders.

Selector switches 34*a–f* are connected between the ignition capacitor first terminal 16*a* and an associated one of the primary coil first terminals 30*a–f*. Numerous electrical switching devices, such as transistors, can be adapted to perform the functions of the selector switches 34*a–f* and, therefore, the selector switches 34*a–f* will not be described in great detail. The selector switches 34*a–f* are normally biased open and are adapted to close in response to receiving a cylinder select signals (see FIG. 4) from a cylinder selector means 36. When the selector switch 34 is biased closed, the ignition capacitor first terminal 16*a* and the primary coil first terminal 30; of an associated transformer 24, are electrically connected, thereby establishing a current path through the primary coil 26.

The cylinder selector means 36 (i.e., ignition timing controller) is provided for operating the selector switches 34*a–f* in a timed sequence corresponding to a desired ignition sequence for the engine. The cylinder selector means 36 may be implemented with any suitable hardware including analog or digital circuits; however, the cylinder selector means 36 is preferably embodied in a microcontroller (MCU) 38 operating under software control. A number of commercially available devices are adequate to perform the control functions of the MCU 38, such as the MC68HC11 series component manufactured by Motorola Inc. of Schaumburg, Ill.

The cylinder selector means 36 receives signals corresponding to engine speed and cylinder position from a speed sensor means 48. Preferably this function is performed using a single sensor such as that disclosed in U.S. Pat. No. 4,972,323 which issued on Nov. 20, 1990 to Luebbering et. al, is assigned to the assignee herein, and the disclosure of which is specifically incorporated by reference. However, it is foreseeable to use separate sensors for engine speed and cylinder position, respectively. The speed sensor means 48 is in the form of a toothed timing wheel or gear 49 and a magnetic pickup unit (MPU) 50 such as a Hall effect device. The timing wheel 49 includes a series of circumferentially spaced teeth 51. In addition, the wheel 49 is mounted on a shaft (not shown) which is in turn coupled to a crankshaft or camshaft of the engine. The wheel 49 thus rotates as the engine is running, causing the teeth to pass beneath the MPU 50. In response to the passage of the teeth, the MPU 50 develops a signal in the form of a pulse train. The positions of the pistons in the engine cylinders are referenced to particular pulses on the signal and the frequency of the signal is responsive to engine speed.

Figure 4:
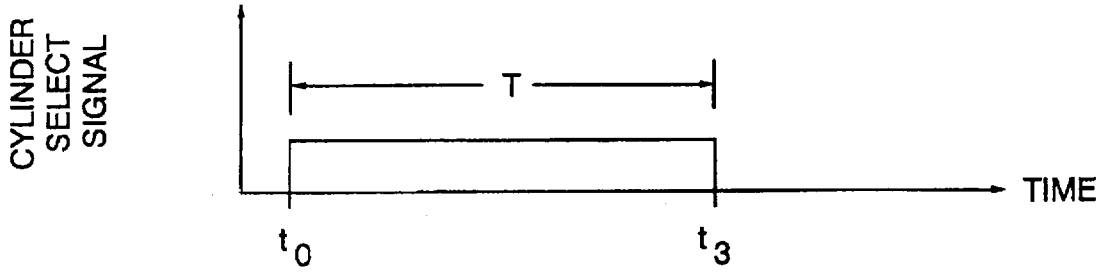
FIG. 4 is a graph of a cylinder select signal during an ignition cycle.

A variety of other parameters can also be input to the cylinder selector means 36, such as engine load and air/fuel ratio. The selector means 36 processes these signals to produce cylinder select signals for controlling operation of the select switches 34*a–f* . The cylinder select means 36 produces the cylinder select signals for a period of time corresponding to the desired spark duration in an associated cylinder as illustrated in FIG. 4. The selector switch 34 to which the selector signal is delivered remains closed while the selector signal is produced. The desired spark duration can be a constant period of time or it can be adjusted in response to sensed engine parameters, as would be apparent to one skilled in the art. Inasmuch as timing controls of this type are well known in the art, no further description of the selector means 36 will be provided.

A modulation switch 52 is connected between the primary coil second terminals 32*a–f* and system ground for completing a current path for the primary coils 26*a–f*. When a cylinder select switch 34 and the modulation switch 52 are closed, current begins to flow from the ignition capacitor 18 through the associated primary coil 26. Numerous electrical switching devices, such as an n-channel MOSFET, can be adapted to perform the functions of the modulation switch 52 and, therefore, the modulation switch 52 will not be described in greater detail.

Figure 5:
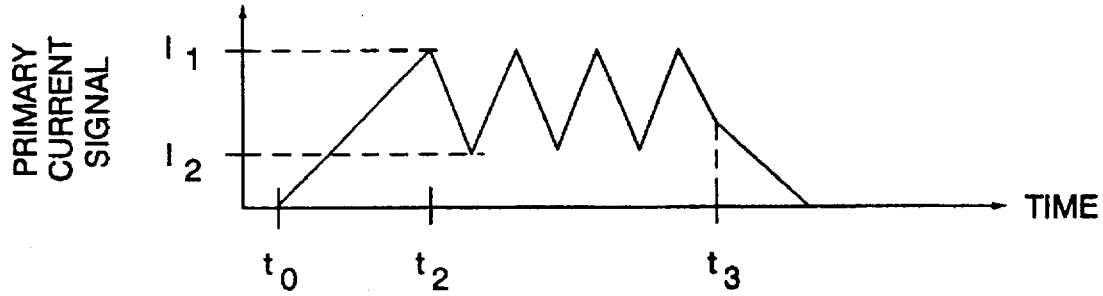
FIG. 5 is a graph of the current through a primary coil during an ignition cycle.

A current sensing means 62 senses the current flowing through any of the transformer primary coils 26*a–f* and responsively produces a primary current signal as illustrated in FIG. 5. The current sensing means 62 includes a first current sensing resistor 64 connected between the selector switches 34*a–f* and the ignition capacitor first terminal 16*a*. A current mirror circuit 66 is connected to the first current sensing resistor 64 such that the current flowing through the resistor 64 is an input to the current mirror circuit 66. The current mirror circuit 66 delivers an output current signal which has a magnitude responsive to the magnitude of the current flowing through any of the primary coils 26*a–f*. Only one current mirror circuit 66 is required since only one of the cylinder select switches 34*a–f* is closed at any given instance in time.

The current mirror circuit 66 includes first and second pup transistors 68,70 wherein both transistors 68,70 have bases connected to the other and to the collector of the first transistor 68. The collectors of the transistors 68,70 are further connected to system ground through first and second resistors 72,74, respectively. The emitter of the first pup transistor 68 is connected to the ignition capacitor first terminal 16*a* through the first current sensing resistor 64. The emitter of the second pup transistor 70 is connected to the ignition capacitor first terminal 16*a* through a second current sensing resistor 76. As would be apparent to one skilled in the art, selection of the ohmic values of the first and second current resistors 64, 76 controls the relationship between the input and output of the current mirror circuit 66.

The output of the current sensing means 62 is delivered to a control logic means 78 which produces control signals in response to the current mirror output signal. The control signals are applied to the modulation switch 52 to respectively open and close the modulation switch 52. The control logic means 78 operates the modulation switch 52 while a selector switch 34 is closed such that the current flowing in an associated primary coil initially rises to a first current threshold I1 which is normally sufficient to cause a spark to arc an associated spark gap 22. Thereafter, the spark is maintained by modulating the current in the primary coil 26 between the first current threshold I1 and a second current threshold I2 which is lower than the first current threshold I1. It should be noted that the current could be modulated at other levels to further minimize the current draw on the capacitor 18, as would be apparent to one skilled in the art.

Figure 6:
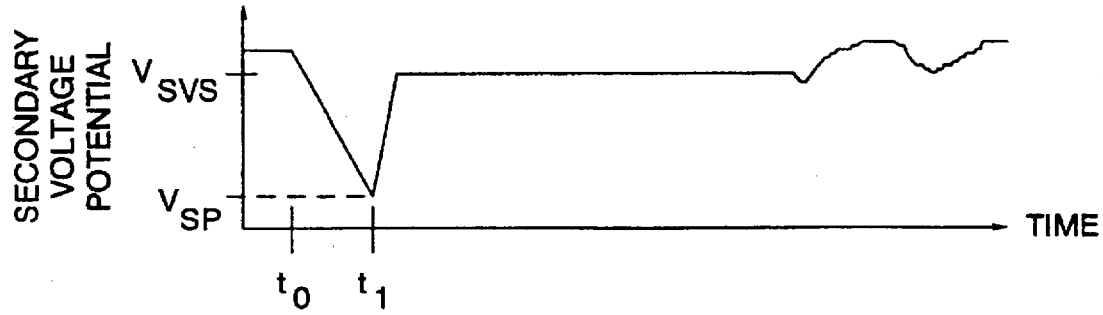
FIG. 6 is a graph of secondary voltage during an ignition cycle.

The time, hereinafter referred to as the spark delay time (DT), required to reach the first current threshold I1 provides an indication of the secondary load because it is a function of the voltage required to initiate a spark across the spark plug gap, (i.e., the characteristic ionization potential $V_{SP}$.) The voltage across the spark plug gap, or the secondary voltage potential, is illustrated in FIG. 6. This time delay is hereinafter referred to as the spark delay time (DT). The spark time delay (DT) is the time between the start of ignition at $t_O$ and the time at which the primary current signal reaches the first threshold I1 at $t_2$. The subject invention measures the spark delay time (DT) and processes it to determine the status of ignition in individual cylinders, as explained below.

The control logic means 78 includes a first comparator 80 having an inverting input terminal adapted to receive the current mirror output signal. The first comparator 80 is an open-collector type comparator having its inverting input terminal connected to the junction of the second pnp transistor 70 and the second resistor 74 through an R-C network 82. The current output from the current mirror circuit 66 establishes a voltage across the second resistor 74 which is applied to the first comparator inverting input-terminal. As should be apparent, this voltage is proportional to the current flowing through the first current sensing resistor 64 and thus to the current in the primary coil 26. The R-C network 82 includes a third resistor 84 serially connected between the junction of the second transistor's emitter and the second resistor 74 and first comparator inverting input terminal. The R-C network 82 further includes a first capacitor 86 connected between the Junction of the third resistor 84 and the first comparator inverting input terminal and system ground.

The non-inverting input terminal of the comparator 80 is connected to a voltage divider network 87 for controlling the voltage level applied thereto. More particularly, the non-inverting input terminal is connected to a preselected reference potential $V_{REF}$ through a pull-up resistor 88 and to system ground through a fourth resistor 90. The non-inverting input terminal is further connected to the output terminal of the first comparator 80 through a seventh resistor 92. The output terminal of the first comparator S0 switches between logic "low" and logic "high" in response to the primary current signal rising above and falling below the the first and second current thresholds I1, I2, respectively.

When the first comparator output terminal is pulled "high," the voltage divider network 87 applies a third voltage potential to the first Comparator non-inverting input terminal. The third voltage potential corresponds to a primary current having magnitude equal to the first current threshold I1. The first comparator output terminal is pulled "low" when the voltage applied to its inverting input terminal rises to the third voltage potential, thereby indicating that the primary current has reached the first current threshold I1. When the first comparator output terminal is pulled "low," the voltage divider network 87 applies a fourth voltage potential, which is lower than the third voltage potential, to the first comparator non-inverting input terminal. The fourth voltage potential corresponds to a primary current equal to the second current threshold I2. The output from the first comparator 80 is delivered to the modulation switch 52 to control operation of the switch. The modulation switch 52 is biased open and closed when the first comparator output is pulled "low" and "high," respectively.

A normal ignition cycle for a cylinder will now be briefly described in connection with FIGS. 4–6. Initially, the modulation switch 52 is biased closed and all of the selector switches 34*a–f* are biased open. At time $t_0$, the cylinder selector means 36 delivers a cylinder select signal to one of the selector switches 34*a–f* , thereby biasing the selector switch closed. Current starts to flow through the primary coil 26 in an associated transformer 24 as illustrated in FIG. 5. The current flowing through the primary coil 26 induces a voltage potential across the spark gap 22 in an associated spark plug as illustrated in FIG. 6. At a time $t_1$, the voltage potential across the spark gap 22 reaches a potential $V_{SP}$ which is sufficient to cause a spark to arc the gap 22. Usually, this voltage is on an order of 10–30 kV. After the initial spark, the voltage required to sustain the spark across the gap 22 is substantially reduced. This voltage is indicated by $V_{SUS}$ and is typically on the order of 1 kV or less.

The current in the primary coil 26 continues to rise until it reaches the first current threshold I1 at time $t_2$. When the current reaches the first threshold I1, the comparator output is pulled "low," thereby opening the modulation switch 52. The primary current then decays through a flyback path until it drops to the second preselected threshold I2. When the current reaches the second threshold I2, the modulation switch is biased closed and the primary current begins to rise again. The primary current is modulated in this manner until the selector signal goes "low" at time $t_3$. When this occurs, the selector switch 52 opens, thereby disconnecting the primary coil first terminal 30 from the ignition capacitor first terminal 16*a*. Thereafter, the voltage across the spark gap drops off to a level insufficient to maintain a spark across the gap.

Referring now to FIG. 3, the subject diagnostic system S will now be described in detail. The invention is based on the premise that the step-up transformers 24*a–f* have a mutual inductance between their primary and secondary coils. Our research shows that changes in transformer output loads, (i.e., the characteristic spark ionization potential $V_{SP}$), can accurately be determined by sensing changes in the primary inductance. Because the voltage provided by the ignition capacitor 18 is maintained at essentially a constant magnitude by the power converter 14, an accurate indication of primary inductance can be obtained by measuring the time required for the primary current to reach a fixed current level, (i.e., the spark delay time (DT).

The diagnostic system 8 measures a spark delay time (DT) which is responsive to the time between production of a cylinder select signal at time time $t_0$ and sparking in a respective cylinder at time $t_1$. It should be noted that the spark delay time (DT) is not an absolute measure of when sparking actually occurs. Rather, what is measured is the time between production of a cylinder select signal at time $t_0$ and the time at which the the primary current reaches the first current threshold I1 at time $t_2$. This time delay is a function of the time at which sparking occurs, and for a normally operating cylinder, the spark delay time (DT) will fall within a given range of values in dependance on such factors as engine load and spark plug gap. The diagnostic system 8 compares spark delay time (DT) to a plurality of thresholds to detect the following ignition conditions: normal ignition, short circuit between the primary and secondary coils, short circuit in the secondary, an open circuit exists in the secondary, and spark plug maintenance conditions.

The diagnostic system 8 is preferably embodied in a combination of electrical hardware and additional program routines in the MCU 38. The diagnostic system 8 includes a first means 98 which receives the cylinder select signals, senses a time delay between reception of a cylinder select signal and sparking in an associated cylinder, and responsively produces a spark delay time signal (DT) which is indicative of the sensed delay. The first means 98 includes a timer means 100 which measures a time delay between the production of a cylinder select signal and the time at which the current in an associated cylinder reaches the first preselected current threshold I1. Preferable the timer means 100 includes a free-running clock which is internal to the MCU 38; however, it is foreseeable that the timer means could be embodied in additional hardware circuitry. Production of a cylinder select signal at time $t_O$ causes a begin time (BT) to be stored in memory. The begin time (BT) corresponds to the time indicated by the free-running clock when the cylinder select signal is produced.

The first means 98 further includes a second comparator 102 having an inverting input terminal connected to the output of the first comparator 80 through a second R-C network 104. The second R-C network 104 is provided to filter out high frequencies caused by ignition noise. The second comparator 102 also has a non-inverting input terminal connected to a voltage divider network 106. The voltage divider network 106 includes sixth and seventh resistors 108, 110 serially connected between a reference voltage $V_{REF}$ and system ground. The second comparator non-inverting input terminal is connected between the resistors 108, 110, thereby maintaining the non-inverting input terminal at a preselected voltage potential. Preferably the preselected voltage potential is one-half the switching voltage of the comparator 102 to ensure proper switching of the comparator 102. The output terminal of the second comparator 102 is held high by a pull-up resistor 112 as long as the non-inverting input terminal has a higher potential than the inverting input terminal. More specifically, the second comparator 102 outputs a square wave signal which tracks the output signal from the first comparator 80.

A monostable multivibrator 114 is adapted to receive the primary current signal and produce a stop time signal in response to the primary current signal reaching the first current threshold I1. For this purpose, the multivibrator 114 has an inverted clock pin (CLK') connected to the second comparator's output terminal and being adapted to sense the comparator's output signal. An inverted reset pin (MS') connected to the junction of the cylinder selector means 36 and the selector switch for receiving the selector signals. A second R-C network 116 is connected between the multivibrator 114 and the cylinder selector means 36 for filtering noise from the selector signal.

The multivibrator 114 also has an output terminal connected to an input terminal on the MCU 38 and being adapted to produce the stop time signal when the primary current reaches the first current threshold I1. More particularly, when the current in a primary coil reaches the first current potential, the second comparator output goes low. This low potential is received by the multivibrator inverted clock pin (CLK'), thereby turning the multivibrator 114 "on", (i.e. causing its output terminal (Q) to go high.) A timing circuit 118 is connected to input pins on the multivibrator to lock the multivibrator 114 "on" for a predetermined period. The timing circuit 118 is connected between the multivibrator external timer pin RX/CX and a reference voltage $V_{REF}$. The timing circuit 118 includes an eighth resistor 120 and a second capacitor 122 which are connected between the reference voltage $V_{REF}$ and the external timing pin RX/CX. The components of the timing circuit 118 are selected to keep the multivibrator 114 "on" for a preselected time, as is common in the art.

When the leading edge of the stop time signal is sensed by the MCU 38, the MCU 38 sets a stop time (ST) variable in memory in response to the time at which the stop time signal was received. The MCU 38 calculates the spark delay time (DT) by subtracting the begin time (BT) from the stop time (ST). The MCU compares the spark delay time (DT) to a plurality of preselected thresholds, and responsively produces a status signal indicating the status of ignition in a respective cylinder, as explained below.

Figure 7:
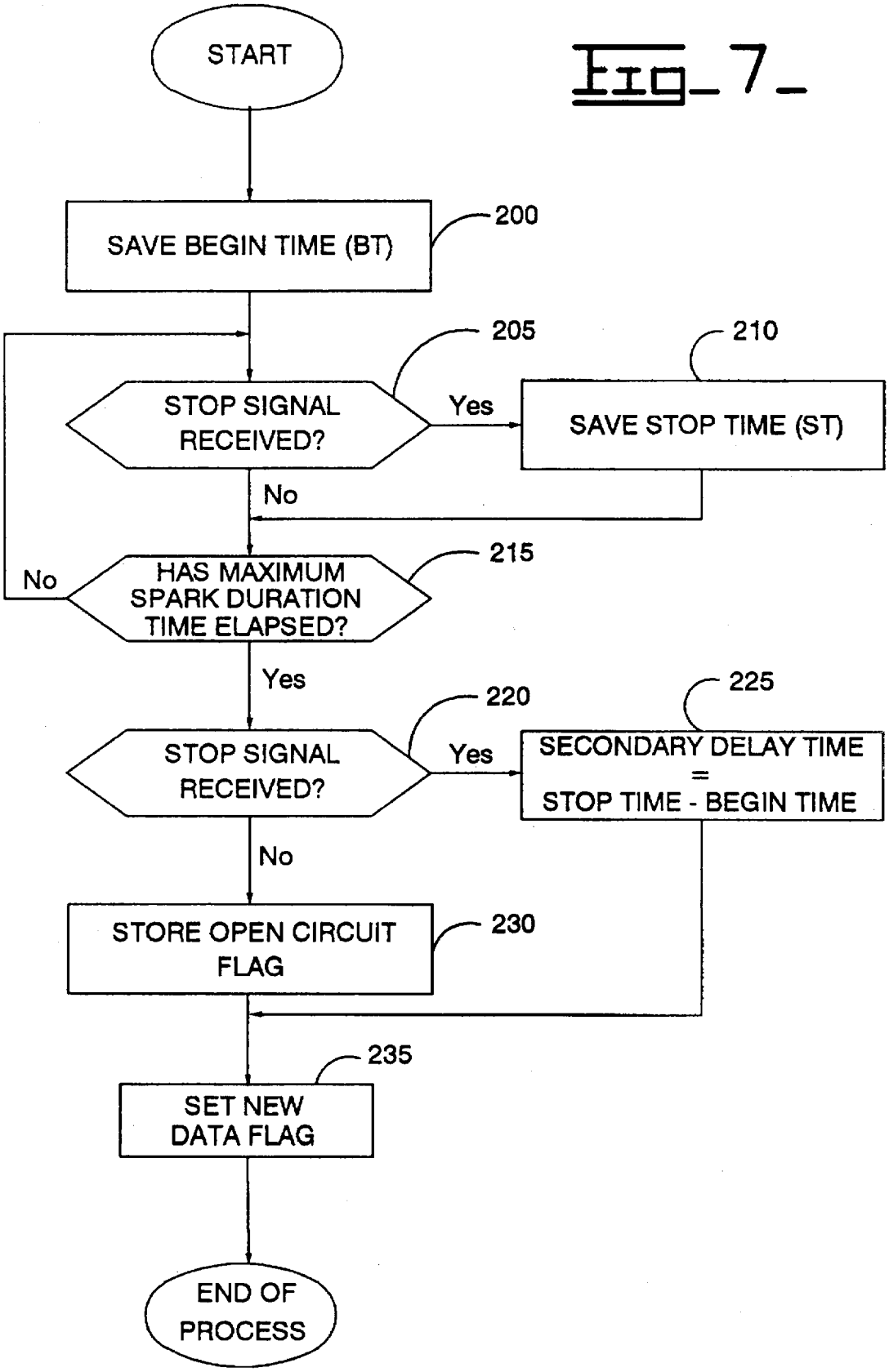
FIG. 7 is a software flowchart illustrating a Delay Time Subroutine which is performed to measure spark delay times for individual cylinders.
Figure 9:
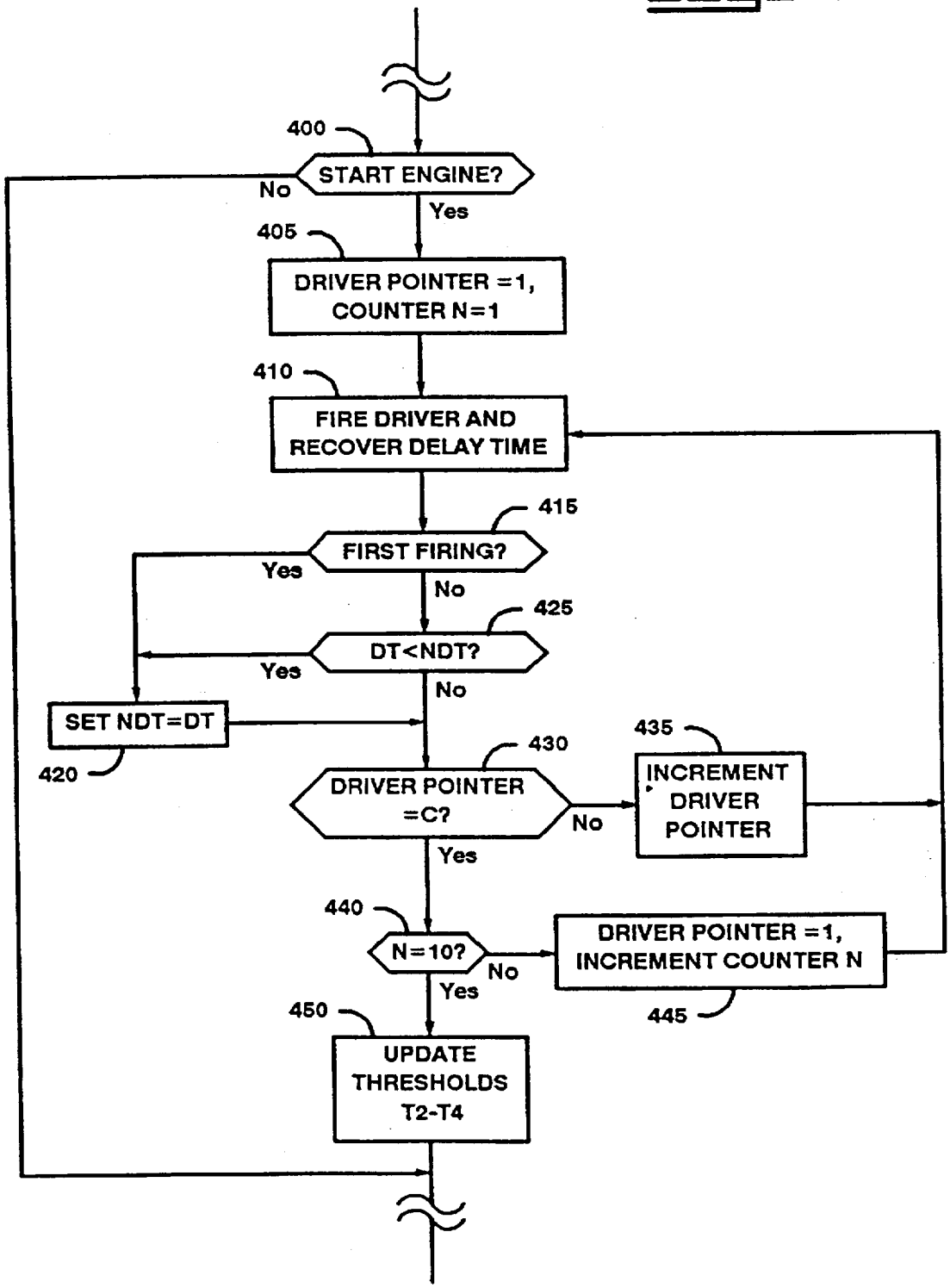
FIG. 9 is a software flowchart illustrating a Delay Time Initialization Subroutine.

Referring now to FIGS. 7–9 software flowcharts for programming the MCU 38 in accordance with certain aspects of the immediate diagnostic system 8 is explained. The program depicted in these flowcharts is particularly well adapted for use with the MCU 38 and associated components described above, although any suitable microprocessor may be utilized in practicing the present invention. These flowcharts constitute a complete and workable design of the preferred software program, and have been reduced to practice on the series MC68HC11 microprocessor system.

The software subroutines may be readily coded from these detailed flowcharts using the instruction set associated with this system, or may be coded with the instructions of any other suitable conventional microprocessor. The process of writing software code from flowcharts such as these is a mere mechanical step for one skilled in the art.

FIG. 7 corresponds to a Delay Time Subroutine which is performed each time a cylinder select signal is produced to update a delay table in memory with spark delay times (DT) for individual cylinders. FIG. 8 is a Diagnostic Subroutine which is executed each time a Main Control Routine (not shown) executes. The Diagnostic Subroutine retrieves spark delay times (DT) from the delay table and uses the spark delay times (DT) to determine the status of ignition in individual cylinders, as explained below. FIG. 9 is a Delay Time Initialization Subroutine which is performed each time the engine is started.

Referring now specifically to FIG. 7, the Delay Time Subroutine will be discussed. The Delay Subroutine is triggered by an interrupt operating in real-time which causes the subroutine to be executed each time a cylinder select signal is produced. Initially, in the block 200, the begin time (BT), as indicated by the free-running clock, is stored in memory. Control is then passed to the block 205, where the routine checks to see if a stop time signal has been received from the multivibrator 114. When a stop time signal is detected in the block 205, control is passed to the block 210, thereby causing the stop time (ST) to be recorded in memory. If a stop time signal has not been received, control is passed to the block 215. In the block 215, the time elapsed since production of the cylinder select signal, as indicated by the free-running clock, is compared to a maximum time limit. The maximum time limit is empirically determined and corresponds to a time which is significantly longer than a spark delay time (DT) for normal ignition. In the preferred embodiment, the maximum time limit is on the order of 300 microseconds; however, this value will vary in dependance on the particular engine on which the system 8 is installed. If the elapsed time exceeds the maximum time limit, control is passed to the block 220. Otherwise, control is returned to the block 205.

Control continues to loop between the blocks 205 to 215 until the maximum time limit is exceeded. Thereafter, control is passed to the block 220 where memory is examined to see if a stop time (ST) was received and recorded in memory. If a stop time (ST) was recorded, control is passed to the block 225 where the spark delay time (DT) is determined by subtracting the begin time (BT) from the stop time (ST). The spark delay time (DT) is then stored in a delay table in memory. The delay table contains spark delay times (DT) for individual cylinders and is updated in accordance with the firing order for the engine. Subsequently, in the block 235, a new data flag is set in memory to indicate that the stored time delay (DT) has been updated.

However, if the test in block 220 indicates that no stop time (ST) was recorded, control is passed to the block 230 where an open circuit flag is set in memory for the cylinder currently attempting to ignite. An open circuit is assumed to be present in a transformer secondary circuit whenever ignition does not occur within the maximum time limit. More specifically, an open circuit in the secondary circuit prevents the voltage across the plug gap from reaching the ionization voltage $V_{SP}$ and, therefore, the primary current never reaches the first current threshold I1 and no stop time (ST) is recorded.

Referring now to FIG. 8, the Diagnostic Subroutine will be discussed in greater detail. The Diagnostic Subroutine is executed each time a Main Control Routine executes, which is preferably every 20 milliseconds. The Diagnostic Subroutine retrieves the spark delay times (DT) from memory to determine the status of ignition in individual engine cylinder. Initially in the block 300, a pointer is initialized to point to the first spark delay time (DT) in the delay table. The delay table contains a delay time for each cylinder stored in order in accordance with the engines firing order. The pointer is incremented after each delay time (DT) is processed and the subroutine is repeatedly executed until all of the spark delay times (DT) have been retrieved and processed.

In the block 302, the delay time (DT) indicated by the pointer is retrieved from the delay table. Control is then passed to the block 305 where the new data flag is checked to determine if this delay time has been updated since the last execution of the main control loop. Typically, not all of the delay times will be new, because the Diagnostic Subroutine is executed every 20 milliseconds whereas the delay times are updated in real time. If the delay time is not new, control is passed to the block 385 where it is determined if all of the delay times have been checked during this execution of the Diagnostic Subroutine. If all of the times have been checked, control is returned to the Main Control Loop. Otherwise, control is passed to the block 390 where the pointer is incremented. Control is then returned to the block 302, causing the next delay time (DT) to be retrieved.

When a new delay time is detected in the block 305, control is passed to the block 310 to begin the diagnostics. The diagnostics include comparing the spark delay time (DT) to a plurality of preselected thresholds T1–T4 to determine the status of ignition in a respective cylinder, as shown in the blocks 310 to 340. The diagnostic routine is capable of detecting short circuits between the primary and secondary coils, short circuits and open circuits in the secondary coil, normal ignition, and predicting when a spark plug needs maintenance such as regapping. The tests performed in the blocks 310 to 340 are summarized in the table below:

| Ignition Condition | Delay Time |
|---|---|
| Primary-Secondary Short | DT <= T1 |
| Secondary Short Circuit | T1 < DT <= T2 |
| Normal Ignition | T2 < DT <= T3 |
| Spark Plug Maintenance | T3 < DT <= T4 |
| Secondary Open Circuit | T4 < DT |

The value of the thresholds T1–T4 can be empirically determined under lab conditions for a given engine. However, preferably the first threshold T1 is a preselected constant and the second, third and fourth thresholds T2–T4 are determined via the Delay Time Initialization Subroutine illustrated in FIG. 9, as explained below.

Returning now to discussion of FIG. 4B, blocks 310 to 340 function to determine the operating status of the cylinder by comparing the measured spark delay time (DT) to the thresholds T1–T4. The condition of the cylinder is recorded by storing an appropriate software flag in a diagnostic table in memory. The diagnostic table indicates the status of ignition in each engine cylinder. Separate flags are provided for indicating the status of ignition in individual engine cylinders.

After the blocks 310 to 340 are executed, control is passed to the block 345 where it is determined if the same fault condition has been detected for five consecutive firings attempts of a given cylinder. This function is performed to insure that faulty ignition conditions are not erroneously indicated. If the fault condition has not been detected for five consecutive firings, control is passed to the block 385.

However, if the fault has occurred for five consecutive firing attempts, control is passed to the block 370. In the block 370 engine load, as indicated by manifold air pressure sensor (not shown), is checked to see if it is above a preselected minimum. If engine load is below the preselected level, control is passed to the block 375. All of the diagnostics except secondary short circuits can be performed regardless of engine load. However, to accurately detect a secondary short circuit approximately ¾ load (150 KPA inlet manifold pressure) is required to distinguish between a shorted secondary coil and a transformer with a lower inductance. Diagnostic times which indicated a short circuit condition are ignored below the preselected minimum engine load because resolution increases with engine load. Therefore, if engine load is below the preselected minimum and a short is indicated, control is passed to the block 385. However, if engine load is above the preselected minimum or if a short circuit is not indicated, control is passed to the block 380.

In the block 380 the diagnostic code stored in the diagnostic table is saved in a fault code table. The fault code table can be accessed by a diagnostic tool (not show) as is common in the art. Moreover, the MCU 38 can be programmed to access the fault code table and responsively display fault codes on a display means, such as a liquid crystal display (not shown). The process of programming the MCU to display the fault codes is a mere mechanical step for one skilled in the art; therefore, it will not be explained in greater detail.

Referring now to FIG. 9, the Delay Time Initialization Subroutine will be explained. This subroutine is performed each time the engine is started, and it operates to determine a no-load spark delay time (NDT) for each cylinder. This no-load spark delay time is then used to set the values of the thresholds T2–T4, as explained below. In the preferred embodiment, this is accomplished by finding the minimum value of the spark delay time (DT) for each cylinder during a preselected number of firings when the engine is being started. Currently, this value is determined by firing each cylinder 10 times under no load conditions and setting the no-load spark delay time (NDT) to the lowest measured spark delay time (DT). Using the minimum value is preferred to other methods such as averaging the delay times because delay times measured during a cylinder's compression stroke would increase an averaged value of the no-load delay times.

Initially, in the block 400, the controller determines if the engine is being started. Numerous methods are conceivable for performing the function of block 400, as would be apparent to one skilled in the art. For example, the controller can be adapted to sense the position of an ignition switch (not shown), operation of a starter motor (not shown), or when engine speed is in a predefined range, such as between 40 rpm and 500 rpm, or a combination of the above tests. If the engine is not being started, control is returned to the main control routine. However, if an engine starting operation is detected, control is passed to the block 405.

In the block 405, a driver pointer and a counter N are initialized. The driver pointer is set to 1 to indicate cylinder number 1 and the counter is set to 1 to indicate the initial pass through Delay Time Initialization Subroutine. Control is then passed to the block 410.

In the block 410, a cylinder select signal is delivered to the cylinder indicated by the driver pointer and the spark delay time (DT) for this cylinder is recorded as was explained above in connection with FIG. 7. Once the delay time (DT) is recorded, Control is passed to the block 415 where it is determined if this is the initial firing for this cylinder. This is accomplished by checking if the counter N is set to 1. If this is the initial firing for this cylinder, control is passed to the block 420 where the no-load delay time (NDT) is recorded. Conversely, if this is not the initial firing for this cylinder, control is passed to the block 425. In the block 425, the spark delay time (DT) recovered in the block 415 is compared to the no-load delay time (NDT) for this cylinder. If the spark delay time (DT) is less than the current value of the no-load delay time (NDT) control is passed to the block 420 causing the spark delay time (DT) to be stored as the no-load delay time (NDT). However, if the delay time (DT) exceeds the no-load delay time, the no-load delay time is not updated and control is passed to the block 430.

In the block 430, it is determined if all of the cylinders have been fired for this loop. This is accomplished by comparing the value of the driver pointer to the number of cylinders as indicated by C. If all of the drivers have not been fired, control is passed to the block 435 where the driver pointer is incremented to point to the next cylinder. Control is then returned to the block 410.

Conversely, if the driver pointer indicates that this is the last cylinder, control is passed to the block 440. In the block 440, the counter N is compared to a preselected value to determine if each cylinder has been fired a preselected number of times. In the preferred embodiment, each cylinder is fired 10 times; however, this is purely a matter of design preference and should not be construed as limiting the present invention. It should be noted that during the Delay Time Initialization Subroutine, normal ignition timing is not employed. Rather the cylinders are sequentially fired 10 times each and the timing is controlled by the software routine. In the present embodiment the entire subroutine takes less than 0.5 seconds to execute on a 16 cylinder engine. If the counter is less than 10, control is passed to the block 445 where the driver pointer is set to point to cylinder number one and the counter is incremented by one. Control is then returned to the block 410.

Conversely, if the counter equals 10, control is passed to the block 450 where the thresholds T2–T4 are updated in response to the recorded no-load delay times. If this subroutine is employed, separate values for the second, third and fourth thresholds T2–T4 are maintained for each cylinder. The second threshold T2 is set to the value of the no-load delay time (NDT) for the respective cylinder. The third threshold T3 is set to the no-load delay time (NDT) for the respective cylinder plus a first preselected value. The fourth threshold T4 is set to the no-load delay time (NDT) for the respective cylinder plus a second preselected value which is larger than the first preselected value. In the system developed for the 3500 SI engine, the first preselected value is 30 microseconds and the second preselected value is 90 microseconds. These values are empirically determined under lab conditions for the particular engine and ignition system being employed. The value of the first threshold T1 is set to a preselected value constant. This value is empirically determined as a value which substantially exceeds the delay time for a cylinder having a short circuit between the primary and secondary coils. In the 3500 SI engine, this value is set at 20 microseconds. In this engine Delay Times (DT) for a primary to secondary short circuit are typically in a range of 4 to 8 microseconds.

Alternatively, the values of the second, third and fourth thresholds can be set as preselected constants. Typical values for the thresholds on the 3500 SI engine, are as follows:

| Ignition Condition | Delay Time (in uS) |
|---|---|
| Primary-Secondary Short | DT <= 20 |
| Secondary Short Circuit | 20 < DT <= 56 |
| Normal Ignition | 56 < DT <= 86 |
| Regap Spark Plug | 86 < DT <= 150 |
| Secondary Open Circuit | 150 < DT |

As should be apparent, the above times will vary in dependence on the particular transformers and engine configuration being used. Therefore, some lab experimentation will be required to ascertain the exact values to be used for the thresholds. Delay times (DT) for each of the diagnostic conditions are measured under laboratory conditions for transformers at the upper and lower ends of acceptable inductances. The thresholds are then set in accordance with the average of the measure delay times (DT).

Figure 12:
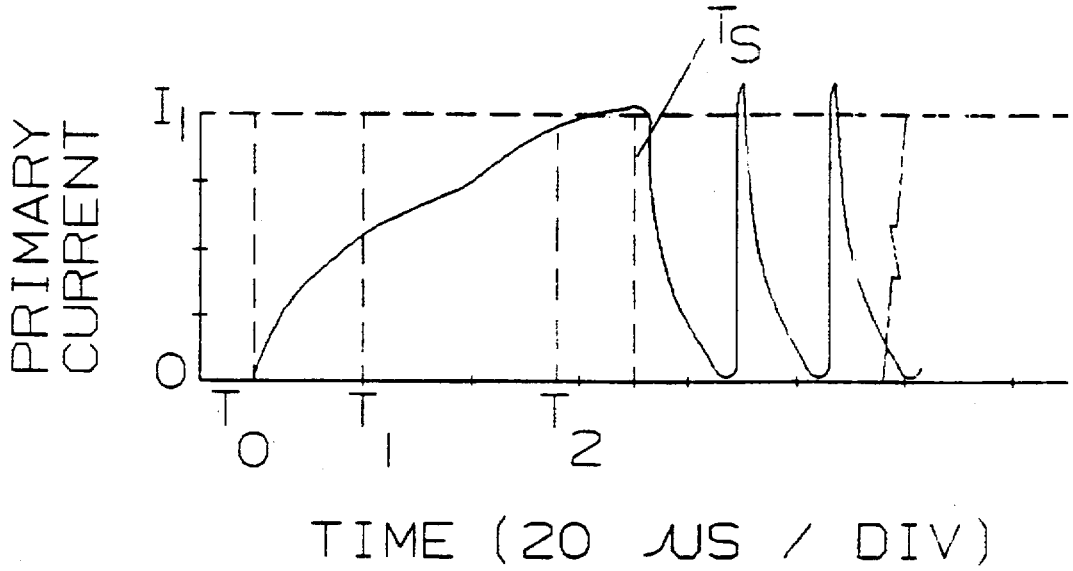
FIG. 12 is a graph of the primary current for a transformer during a normal ignition cycle.
Figure 13:
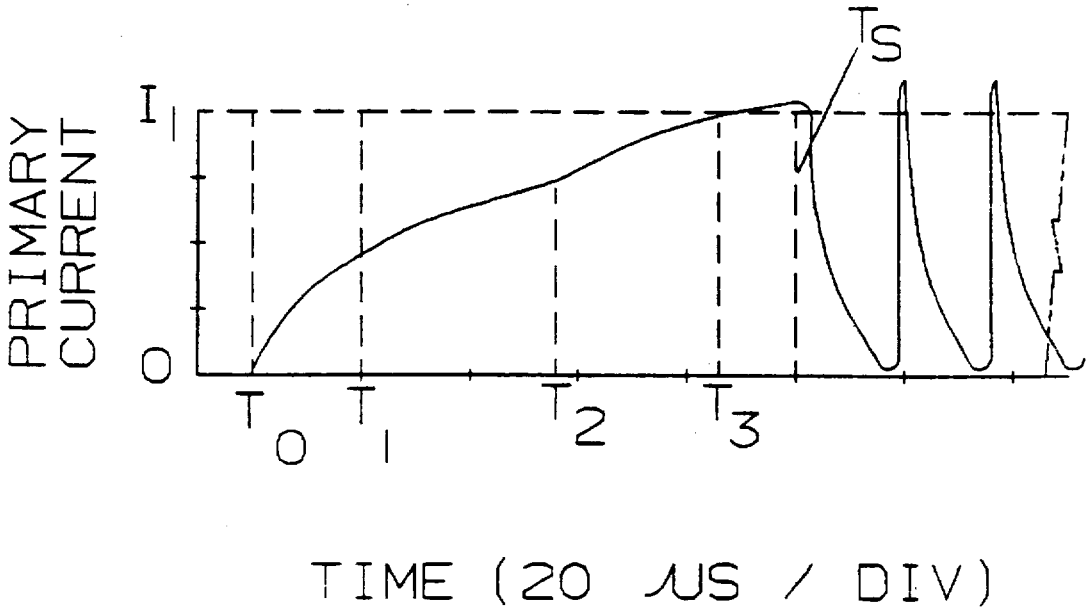
FIG. 13 is a graph of the primary current for a transformer during a spark plug maintenance condition.
Figure 14:
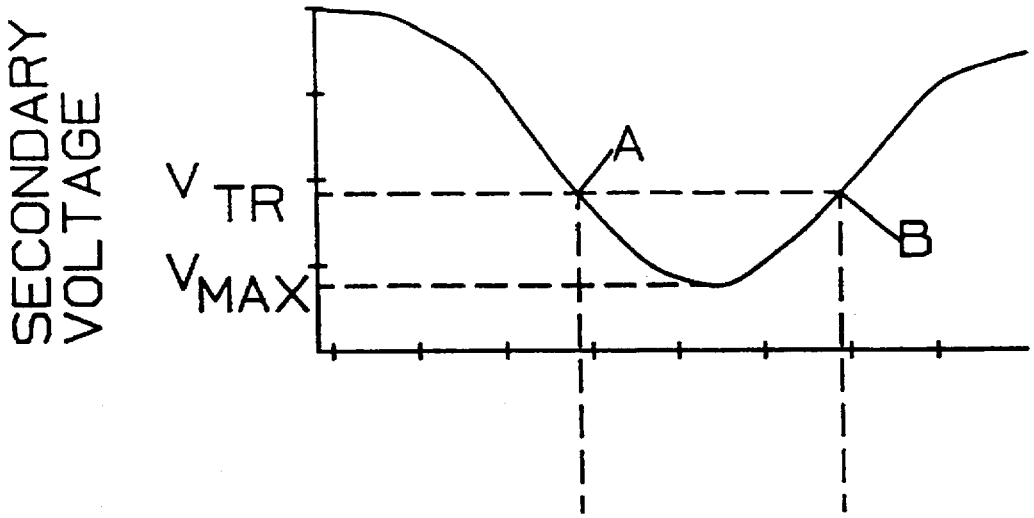
FIG. 14 is a graph of the secondary voltage for a transformer having a secondary open circuit.

The relationship between the ionization potential $V_{SP}$ and the spark delay time (DT) for various fault conditions is illustrated in FIGS. 10–15. FIGS. 10, 11, 12, 13 and 15 are plots of primary current versus time for a primary to secondary short circuit, a secondary short circuit, a normal ignition, a plug maintenance condition and an open circuit, respectively. FIGS. 14 is a plot of secondary voltage versus time for an open circuit condition.

Figure 10:
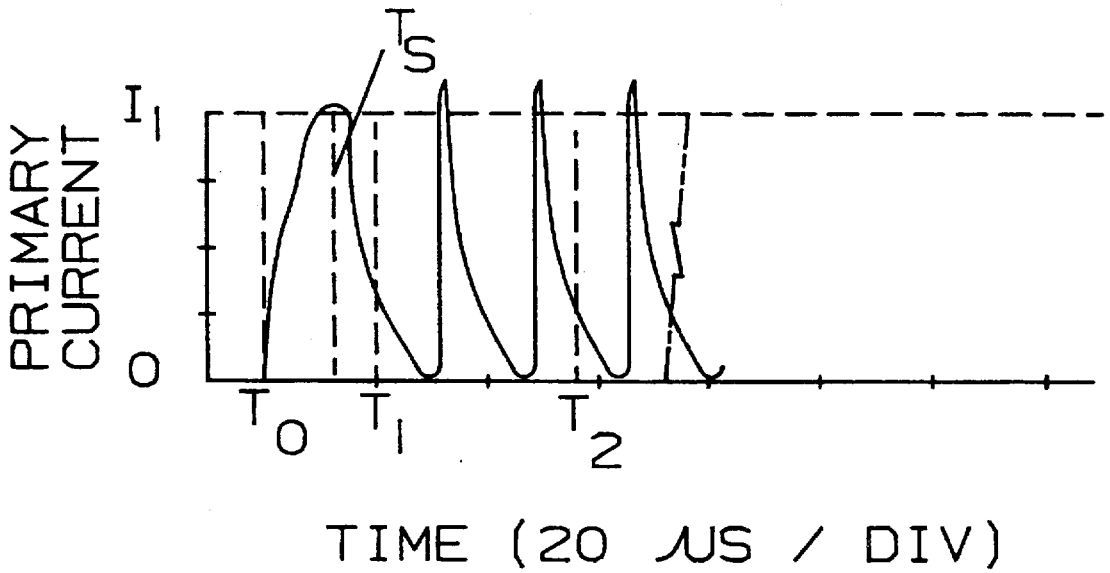
FIG. 10 is a graph of the primary current for a transformer having a primary to secondary short circuit.
Figure 11:
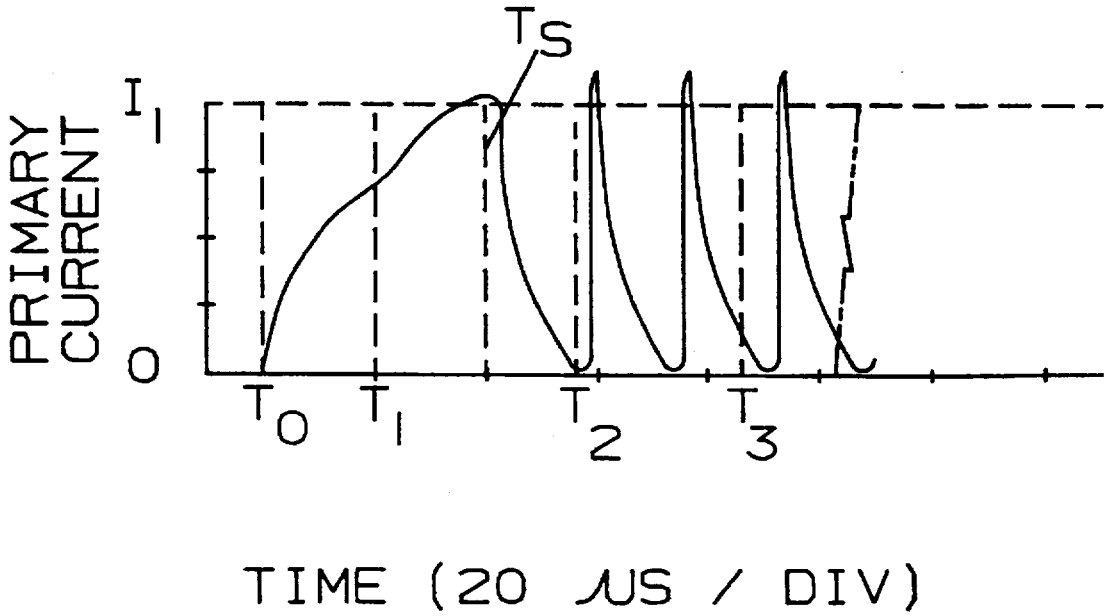
FIG. 11 is a graph of the primary current for a transformer having a secondary short circuit.

In the case of a primary to secondary short circuit, the primary current nearly instantaneously rises to the first preselected current threshold I1, as illustrated by FIG. 10. As was stated above, this usually occurs within 4 to 10 microseconds of the begin time TB. In the case of a secondary short circuit, as illustrated in FIG. 11, there is still a rapid rise in the primary current, but it is less rapid than with a primary to secondary short. For a secondary short, the current will reach the first threshold in a value equal to or less than the no-load delay time. Since the second threshold T2 is set to the no-load delay time, any delay times which are between the first and second thresholds T1, T2 are assumed to indicate a secondary short circuit condition.

In the case of normal ignition, as illustrated in FIGS. 12, the primary current gradually increases until sparking occurs. Thereafter the primary current rapidly increases to the first current threshold I1. Upon reaching the first current threshold I1, the primary current is modulated to maintain sparking, as set forth above. The time at which sparking occurs is controlled by numerous factors, as set forth above. Spark delay times (DT) for normal ignition fall between the second and third current thresholds T2, T3. The second threshold T2 corresponds to the no-load delay time for this cylinder and the third threshold T3 is determined by adding the first preselected constant of 30 microseconds to the no-load delay time.

The primary current trace for a spark plug needing maintenance is illustrated in FIG. 13. It is assumed that a spark plug needs maintenance, such as regapping, if the delay time falls between the third and fourth thresholds T3, T4. More specifically, if the spark plug needs regapping, primary current will follow a curve similar to that for normal ignition. However, sparking will be delayed because a higher ionization potential is required to arc the spark gap. This is because a spark plug is designed to operate at a particular gap setting. As the gap increases, due to erosion of the electrodes, the characteristic ionization potential $V_{SP}$ for the spark plug increases and so does the spark delay time (DT). The fourth threshold T4 corresponds to the maximum allowable spark gap for a spark plug. This threshold is determined by adding the second preselected value of 90 microseconds to the no-load spark delay time for the cylinder. The second preselected value is empirically determined by measuring the no-load delay times for spark plugs having the maximum desired gap or maximum desired ionization potential $V_{SP}$.

Figure 15:
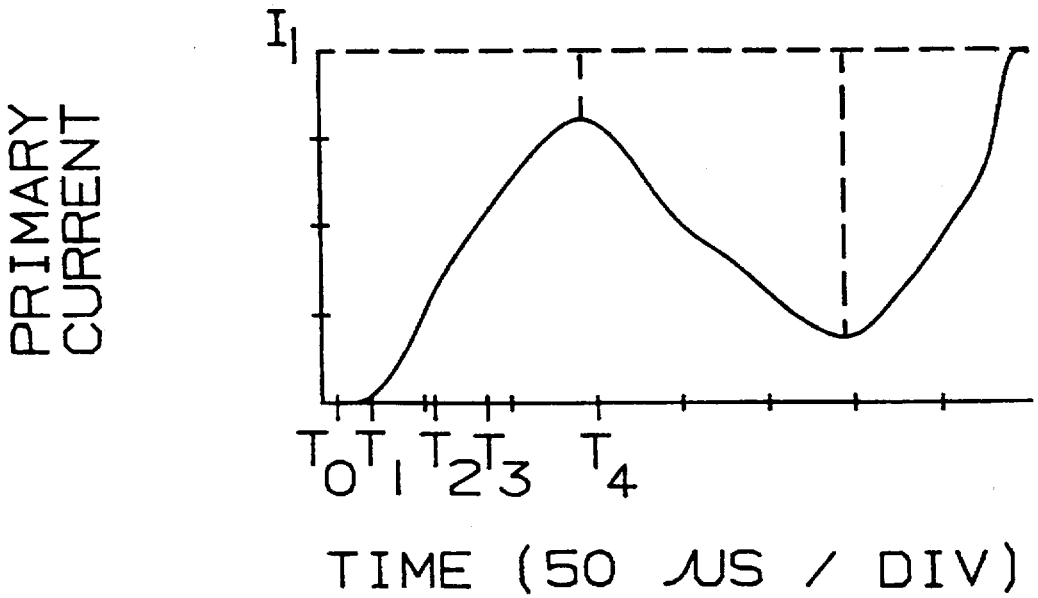
FIG. 15 is a graph of the primary current for a transformer having a secondary open circuit.

Delay times (DT) which exceed the fourth threshold T4 are assumed to indicate an open circuit condition. The secondary voltage and primary current for a cylinder experiencing an open circuit condition are illustrated in FIGS. 14 and 15. As can be seen, the primary current never reaches the first preselected threshold I1. Rather the primary current initially increases until it reaches some level at point A. The current then decreases to some level at point B and thereafter increases to the preselected threshold I1. Points A and B correspond respectively to the times at which secondary voltage rises above and falls below the turns ratio voltage $V_{TR}$. The turns ratio voltage as referred to herein is determined in accordance with the following equation:

$$V_{TR}=TR * V_C$$

Where TR corresponds to the turns ratio as determined by the ratio of coil turns in the primary to that of the secondary coil, $V_c$ corresponds to the voltage applied to the primary coil by the charging capacitor. As can be seen from 14, the maximum secondary voltage $V_{MAX}$ is not limited to the turns ratio voltage. Rather, additional voltage is obtained because the secondary coil is forced into resonance. The maximum voltage $V_{MAX}$ obtainable is limited by the particular transformer used, and it is not uncommon in the art to obtain a maximum voltage which is nearly twice that of the turns ratio voltage $V_{TR}$. If sparking does not occur, the secondary voltage begins to decrease upon obtaining the maximum voltage $V_{MAX}$. When secondary voltage drops below the turns ratio voltage $V_{TR}$ at point B, the primary current begins to increase again. The relationship between primary current and secondary voltage is controlled by the mutual inductance of the transformer. The phenomena of mutual inductance is well known in the art and will not be explained in grater detail.

Industrial Applicability

Assume that the diagnostic system 8 is installed on a multicylinder engine which is operating at full throttle. The cylinder selector means 36 selectively produces cylinder select signals to effect ignition in individual cylinders in accordance with the firing order of the engine. In response to production of the cylinder select signal, the Delay Time Subroutine is executed. Initially, in the block 200, a begin time (BT) is stored in memory. The cylinder select signal also biases a respective selector switch 34 to closed, thereby allowing current to flow through an associated primary coil 30. The current sensing means 62 senses the current flowing through the primary coil 26 and responsively produces a primary current signal. The monostable multivibrator 114 is adapted to produce a stop time signal in response to the primary current signal reaching the first current threshold I1.

The Delay Time Subroutine Control continues to loop between the blocks 205 to 215 until the maximum time limit is exceeded. If a stop time signal is detected during this time, a delay time (DT) is calculated and stored in the delay table. Otherwise, an open circuit is assumed to have occurred and the software diagnostic table is updated accordingly.

Independently, the Diagnostic Subroutine is executed each time the Main Control Loop is executed. The Diagnostic Subroutine retrieves the updated delay times (DT) from the delay table and processes the delay times to ascertain the status of ignition in respective engine cylinders. If the same fault is detected for a cylinder for five consecutive firings of a cylinder, a fault code is recorded in a fault code table. The MCU 38 can be programmed to display fault codes on a display panel (not shown) in response to the contents of the fault code table, thereby warning an operator of fault conditions in the secondary circuits of individual cylinders. However, to reduce cost, the control system is provided with a warning light (not shown) which is activated whenever faulty ignition occurs. The warning light notifies the operator of the faulting operating condition. The contents of the diagnostic table can then be accessed by a diagnostic tool to determine exactly which faults have been detected.

Preferably, the diagnostic tool is programmed to display fault codes in a J1587 format, two-part code which includes a failure mode identifier (FMI) and a component identifier (CID). The format CDI/FMI format is xxx/yy. Transformer secondary diagnostic codes are indicated by a CID of 4xx, where xx indicates the specific cylinder. FMI is coded to indicate the following conditions: a primary to secondary short Circuit, a secondary short circuit, a secondary open circuit or plug maintenance condition.

What is claimed is:

1. An apparatus (8) for monitoring ignition in individual cylinders of a multicylinder engine having an ignition system (10) which includes individual transformers (24*a–f*) for each cylinder, each transformer (24*a–f*) having a primary coil (26*a–f*) and a secondary coil 28*a–f*), the secondary coil (28*a–f*) being electrically connected in series with a spark gap (22*a–f*) in an associated one of the cylinders, the ignition system (8) including a means to receive cylinder select signals and responsively connect respective transformer primary coils (26*a–f*) to a power source (18) to induce current flow through a respective primary coil (26*a–f*), the current flow through the primary coil (26*a–f*) resulting in a voltage potential across an associated spark gap (22*a–f*) which normally increases to a magnitude sufficient to cause a spark across the spark gap (22*a–f*), comprising:

first means (98) for receiving the cylinder select signals, sensing a time delay between the reception of a cylinder select signal and sparking in a respective cylinder and responsively producing a delay signal indicative of the sensed time delay;

diagnostic means (124) for receiving the delay signal, comparing the delay signal to a plurality of preselected thresholds, and responsively producing a status signal indicating the status of ignition in a respective cylinder.

2. An apparatus (8) as set forth in claim 1 wherein the diagnostic means (124) produces one of a primary to secondary short secondary short circuit, normal ignition, spark plug maintenance, and open circuit signals in response to the delay signal.

3. An apparatus (8) as set forth in claim 2 wherein the diagnostic means (124) produces the secondary to primary short signal in response to the delay signal being within a first range of values, the secondary short circuit signal in response to the delay signal being within a second range of values which exceeds the first ranges of values, produces the normal ignition signal in response to the delay signal being within a third range of values which exceeds the first and second ranges of values, produces the spark plug maintenance signal in response to the delay signal being within a fourth range of values which exceeds the first, second and third ranges of values, and produces the open circuit signal in response to the delay signal being fifth range of values which exceeds the first, second, third, and fourth ranges of values.

4. An apparatus (8) as set forth in claim 3 wherein the diagnostic means (124) produces the primary to secondary short signal in response to the delay signal being less than or equal to a first, produces the secondary short circuit signal in response to the delay signal being greater than the first threshold and less than or equal to a second threshold; produces the normal ignition signal in response to the delay signal being greater than the second threshold and less than or equal to a third threshold, produces the spark plug maintenance signal in response to the delay signal being greater than the third threshold and less than or equal to a fourth threshold, and produces the open circuit signal in response to the delay signal being greater than the fourth threshold.

5. An apparatus (8) as set forth in claim 1 wherein the delay signal is produced in response to the time required for the current flowing through a primary coil (26*a–f*) to reach a preselected current threshold which is sufficient to cause a spark to arc an associated spark gap (22*a–f*).

6. An apparatus (8) as set forth in claim 5 wherein the first means (98) includes:

current sensing means (62) for sensing a current flowing through any of the primary coils (26*a–f*) and responsively producing a primary current signal;

a monostable multivibrator (114) adapted to receive the primary current signal and produce a stop time signal in response to the primary current signal reaching the preselected current threshold; and timer means (100) for receiving the cylinder select and stop time signals and producing the delay signal in response to a time delay between the reception of the cylinder select and stop time signals.

7. An apparatus as set forth in claim 4 wherein the first, second, third and fourth thresholds are empirically determined constants.

8. An apparatus as set forth in claim 4, including a means for determining a no-load delay time for each cylinder and separate values of the second, third and fourth thresholds are maintained for each cylinder, and these values are calculated in response to the no-load delay time for a respective cylinder.

9. An apparatus as set forth in claim 7 wherein the second threshold is set to the no-load delay time for a respective cylinder, the third threshold is set to the no-load delay time for a respective cylinder plus a first preselected value and the fourth threshold is set to the no-load delay time for a respective cylinder plus a second preselected value which exceeds the first threshold.

10. An apparatus (8) for monitoring ignition in an engine cylinder, ignition in the engine cylinder being controlled by an ignition system (10) which includes a transformer (22) having primary and secondary coils (26,28), the secondary coil (28) being electrically connected in series with a spark gap (22) in the cylinder, the ignition system (8) further including a selector switch 34 being adapted to receive a cylinder select signal and responsively connect the transformer primary coil (26) to a power source (18) to induce current flow through the primary coil (26), the primary current resulting in a voltage potential across the spark gap (22) which normally increases to a magnitude sufficient to cause a spark across the spark gap (22), comprising:

current sensing means (62) for sensing a current flowing through the primary coil and responsively producing a primary current signal;

a monostable multivibrator (14) adapted to receive the primary current signal and produce a stop time signal in response to the primary current signal reaching the preselected threshold;

timer means (100) for receiving the cylinder select and stop time signals and producing a delay signal in response to a time delay between the reception of the cylinder select and stop time signals; and diagnostic means (124) for receiving the delay signal and producing a primary to secondary short circuit signal in response to the delay signal being within a first range of values, producing a secondary short circuit signal in response to the delay signal being within a second range of values which exceeds the first range of values, producing a normal ignition signal in response to the delay signal being within a third range of values which exceeds the first and second ranges of values, producing a spark plug maintenance signal in response to the delay signal being within a fourth range of values which exceeds the first, second and third ranges of values, and producing an open circuit signal in response to the delay signal exceeding the first, second, third and fourth ranges of values.

11. A method for monitoring ignition in an engine cylinder, ignition in the engine cylinder being controlled by an ignition system (10) which includes a transformer (22) having primary and secondary coils (26,28) the secondary coil (28) being electrically connected in series with a spark gap (22) in the cylinder, the ignition system (8) including a selector switch (34) being adapted to receive a cylinder select signal and responsively connect the transformer primary coil (26) to a power source (18) to induce current flow through a the primary coil (26), the current flow through the primary coil (26) resulting in a voltage potential across the spark gap (22) which normally increases to a magnitude sufficient to cause a spark across the spark gap (22), comprising the steps of:

sensing a current flowing through the primary coil and responsively producing a primary current signal;

producing a stop time signal when the primary current signal reaches a preselected threshold which is normally sufficient to cause a spark to arc the spark gap (22);

producing a delay signal in response to a time delay between the production of the cylinder select and stop time signals; and comparing the delay signal to a plurality of preselected thresholds and responsively producing a status signal indicating the status of ignition in the cylinder.

12. A method as set forth in claim 11 wherein the step of producing a status signal includes producing a primary to secondary short signal in response to the delay signal being within a first range of values, producing a short circuit signal in response to the delay signal being within a second range of values which exceeds the first range of values, producing a normal ignition signal in response to the delay signal being within a third range of values which exceeds the first and second ranges of values, producing a spark plug maintenance signal in response to the delay signal being within a fourth range of values which exceeds the first, second and third ranges of values, and producing an open circuit signal in response to the delay signal exceeding the first, second, third and fourth ranges of values.

13. A method as set forth in claim 12 wherein the first, second, third and fourth thresholds are empirically determined constants.

14. A method as set forth in claim 12, wherein separate values of the second, third and fourth thresholds are maintained for each cylinder and these values are calculated in response to a no-load delay time for a respective cylinder.

15. A method as set forth in claim 14, wherein the second threshold is set to the no-load delay time for a respective cylinder, the third threshold is set to the no-load delay time for a respective cylinder plus a first preselected value and the fourth threshold is set to the no-load delay time for a respective cylinder plus a second preselected value which exceeds the first threshold.

* * * * *

Disclaimer and Dedication 5,672,972—Steven R. McCoy, Washington; Horst Scheel, Peoria, both of Ill. DIAGNOSTIC SYSTEM FOR A CAPACITOR DISCHARGE IGNITION SYSTEM. Patent dated Sept. 30, 1997. Disclaimer and Dedication filed Oct. 14, 1997, by the assignee, Caterpillar Inc.

Hereby disclaims and dedicates to the public the remaining term of said patent.

(*Official Gazette,* January 13, 1998)